United States Patent [19]

Bussen et al.

[11] 4,279,461

[45] Jul. 21, 1981

[54] WEDGE CONNECTOR

[75] Inventors: Michael R. Bussen, Arnold; David F. Winter, Kirkwood, both of Mo.

[73] Assignee: International Telephone and Telegraph Corporation, New York, N.Y.

[21] Appl. No.: 83,373

[22] Filed: Oct. 10, 1979

[51] Int. Cl.[3] ..... H01R 4/44; H01R 4/50

[52] U.S. Cl. ..... 339/246; 339/247; 339/270 R; 339/273 R

[58] Field of Search ..... 339/247, 273, 249 A, 339/246, 270

[56] References Cited

U.S. PATENT DOCUMENTS

| | | | |
|---|---|---|---|
| 2,106,724 | 2/1938 | Cope | 339/247 |
| 3,280,856 | 10/1966 | Broske | 339/247 |
| 3,588,791 | 6/1971 | Polidori | 339/247 |

*Primary Examiner*—John McQuade

*Attorney, Agent, or Firm*—James B. Raden; William J. Michals

[57] ABSTRACT

The wedge connector includes a longitudinally extending spring member which is generally C-shaped in cross section and which is tapered along its longitudinal length. A correspondingly tapered and longitudinally extending wedge member is insertable into the spring member and includes a pair of arcuately shaped retaining extensions along one side of the wedge member. The wedge member includes a plurality of longitudinally extending threaded bore holes for receiving a bolt which extends perpendicularly through the spring member wall. Accordingly, the wedge connector can be bolt-assembled or impact-tool-assembled by respectively reversing the position of the wedge member.

4 Claims, 7 Drawing Figures

WEDGE CONNECTOR

BACKGROUND OF THE INVENTION

This invention relates to electrical connectors and, more particularly, to wedge-type electrical connectors for making a splice between two electrical cables.

Electrical connectors in which a C-shaped body member and a wedge which is drivable into the body member so as to drive a pair of conductors into wedging engagement with the inner arcuately shaped portion of the C-shaped body member are known and have been widely used in the art. The wedge member of these prior art devices generally takes the form of an I-shaped member wherein the top and bottom portion thereof are arcuately shaped to conform to the circumference of the cables to be joined. The wedge of these prior art devices is driven into the C-shaped body member by means of a powder actuated impact tool, a hydraulic ram, or by driving the wedge member by means of a hand tool.

The present invention is directed to such a wedge connector but is of an improved design and which is more versatile in that the wedge connector can be impact-tool assembled or mechanically assembled in order to meet the needs of a given application.

SUMMARY OF THE INVENTION:

Briefly, a wedge connector for joining a pair of conductors in electrically conductive relationship therewith is provided. The connector includes a generally tubular and longitudinally extending spring member having a substantially C-shaped cross section which tapers from a first cross-section at one end thereof to a smaller cross section at the other end thereof. A longitudinally extending wedge member which is insertable into the spring member length of which corresponds to the length of a spring member is provided. The wedge member is generally trapezoidal in cross section and tapers along the length of the wedge member to correspond to the taper of the spring member. The distance between the longitudinal edges at points along one side of the wedge member is greater than the corresponding distance between the longitudinal edges along the other side of the wedge member. The sides of the wedge member which confront the arcuate inside portions of the C-shaped spring member respectively further include arcuately curved surface portions extending from the longitudinal edges along one side of the wedge member to an intermediate point between the longitudinal edges of the confronting surface sides of the wedge member. Accordingly, the respective arcuately curved portions of the C-shaped spring member and the wedge member form segments of an imaginary substantially circular line generally conforming to the circumference of the conductors.

BRIEF DESCRIPTION OF THE DRAWING

The advantages of this invention wil become more readily appreciated as the same becomes completely understood by reference to the following detailed description when taken in conjunction with the accompanying drawing wherein.

DETAILED DESCRIPTION

Figure 1:
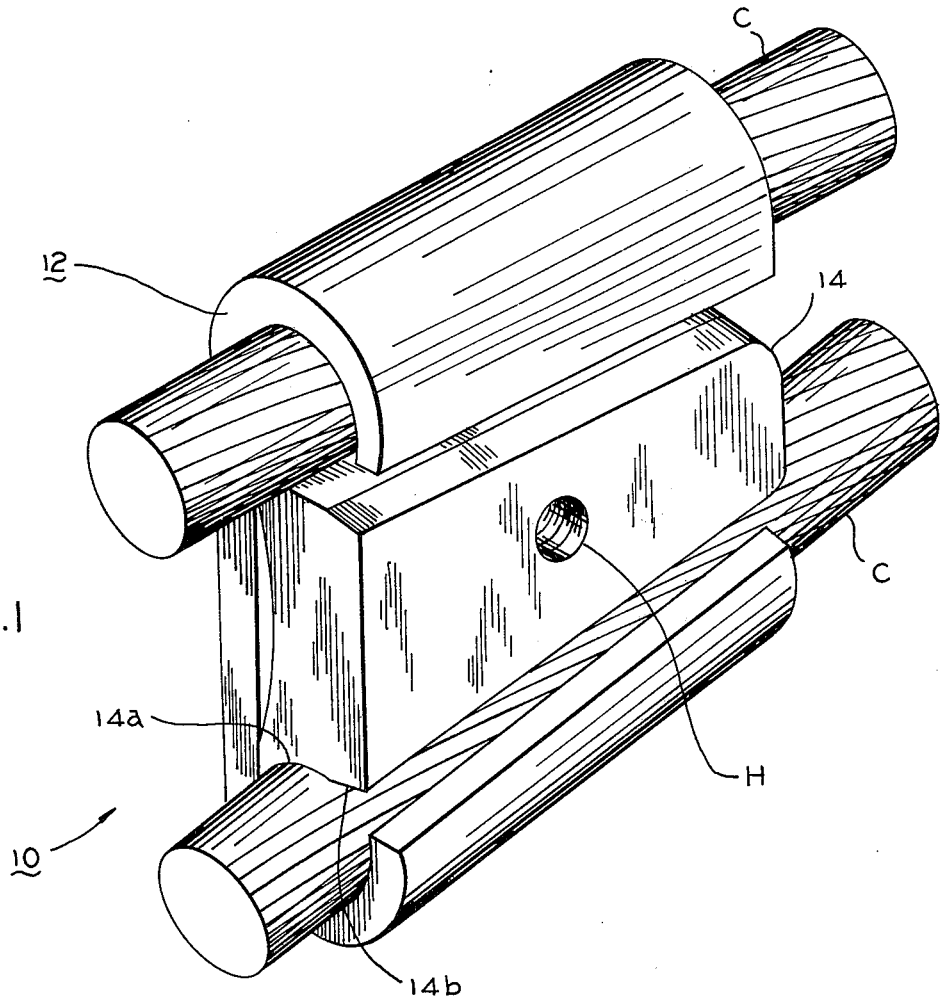
FIG. 1 is a perspective view of the wedge connector in accordance with the principles of the present invention.

Referring now to FIG. 1 there is shown generally at 10 a perspective view of a wedge connector in accordance with the teachings of the present invention. Wedge connector 10 includes a longitudinally extending spring member 12 having a substantially C-shaped cross section which tapers from a first cross section at one end thereof to a smaller cross section at the other end thereof. Wedge connector 10 further includes a longitudinally extending wedge member 14 which is insertable into spring member 12. Wedge member 14 is of a length which is in proportion to the length of spring member 12 and, in accordance with the present invention, is generally trapezoidal in cross section. Wedge connector 10 is illustrated in conjunction with a pair of electrical cables C and it will be appreciated by those skilled in the art that such a wedge connector is particularly useful for cables where a tap must be made in the middle of the line and wherein the end of the cable is not accessible. In such applications, the C-shaped member is hung onto the middle of at least one of the cables and the wedge member 14 is driven between the two conductors. In currently preferred practice, spring member 12 comprises a material having enhanced elastic spring qualities, and the material of wedge member 14 preferably comprises an electrically conductive material.

Wedge member 14 of FIG. 1 further includes a threaded bore hole H which is utilized to fasten wedge member 14 to spring member 12 as by way of a threaded fastener or bolt extending from an aperture or bore hole provided in a central portion of spring member 12. That is, as illustrated more clearly in FIG. 2, by reversing the position of wedge member 14 the cross-sectionally generally trapezoidally shaped wedge member can be drawn, by means of a fastener such as a threaded bolt, into the central portion of the C-shaped spring member 12 until the arcuately curved portions of wedge member 14 are brought into compressive engagement with the cables.

Figure 2:
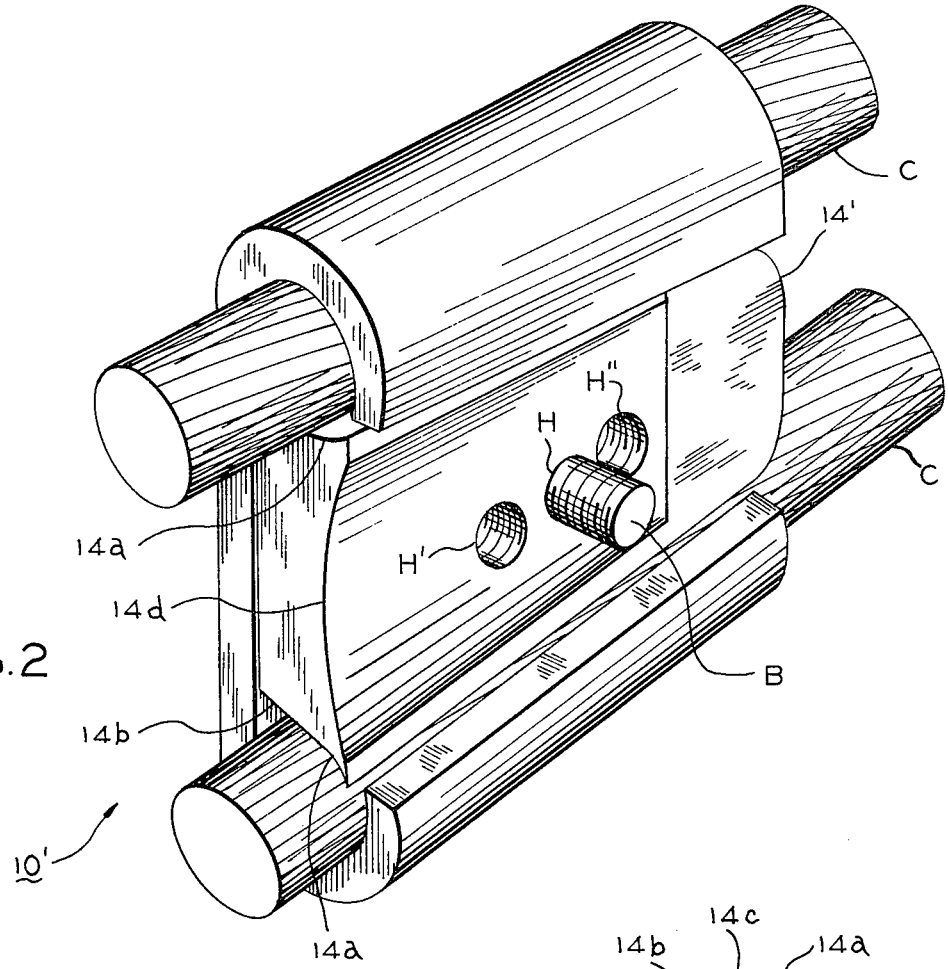
FIG. 2 is a perspective view similar to the wedge connector of FIG. 1 but which further includes means for extending the range-taking capability of the wedge connector.

Referring now to FIG. 2 there is shown a wedge connector 10' including a wedge member 14' which differs from wedge member 14 of FIG. 1 in that a plurality of threaded bore holes H, H' and H'' are provided so as to facilitate a given extended range-taking capability when wedge connector 10' is adapted for bolt assembly by reversing the position of the wedge member as opposed to the driven wedge method illustrated in FIG. 1. That is, if the given application includes cables having a smaller diameter than that illustrated in FIGS. 1 and 2 wedge member 14' can be translated so that the threaded bolt B threadedly engages the left-hand threaded bore hole H' as illustrated in FIG. 2. Thus, the arcuately curved portions of wedge member 14' are effectively translated upwardly into circumferential engagement with the smaller diameter cables.

Figure 3A:
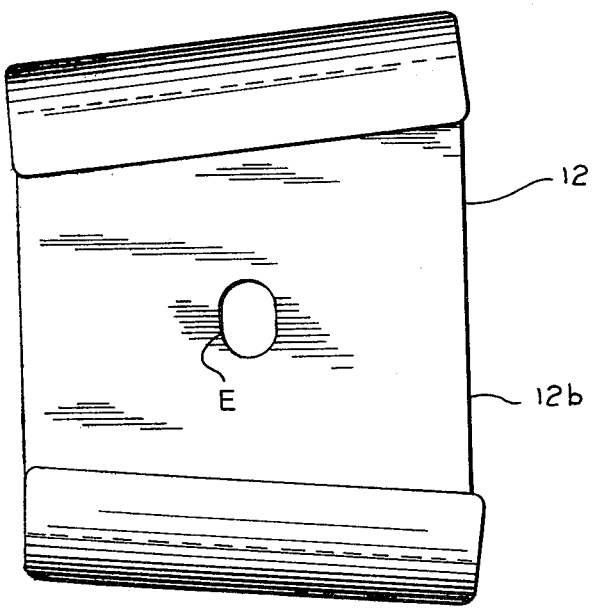
FIGS. 3*a* and 3*b* illustrate plan and end views of the C-shaped body member of the wedge connector as illustrated in the previous drawing figures; and, FIGS. 4*a*–4*c* illustrates various views of the wedge member for use with the wedge connector of the previous drawing figures and in accordance with the principles of the present invention.
Figure 3B:
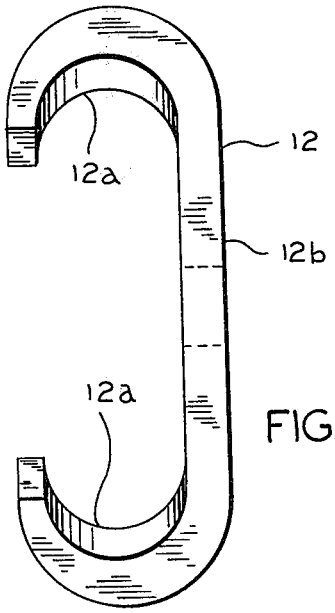

Referring now to FIGS. 3*a* and 3*b* there are shown plan and end views of spring member 12 of FIGS. 1 and 2. It can be seen that spring member 12 includes arcuate inside portions 12*a*. It can also be seen that the central portion 12*b* of spring member 12 includes an elongated bore hole E for receiving threaded fastener B while permitting a given range of lateral adjustment. It will be appreciated by those skilled in the art that spring member 12 may include a plurality of bore holes E so as to provide extended range taking capability similar to the technique employed with wedge member 14'. Further, such bore holes can also be provided as round threaded bore holes adapted to receive a fastener projecting from the associated wedge member.

Figure 4A:
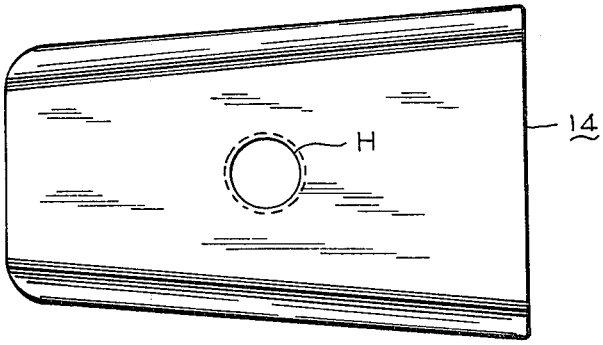
Figure 4B:
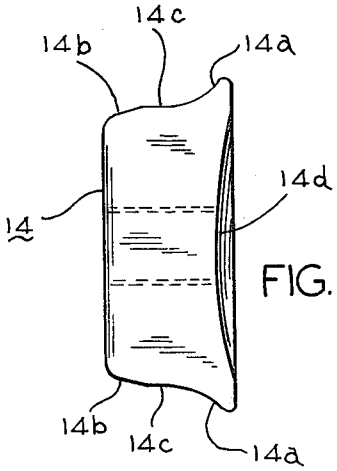
Figure 4C:
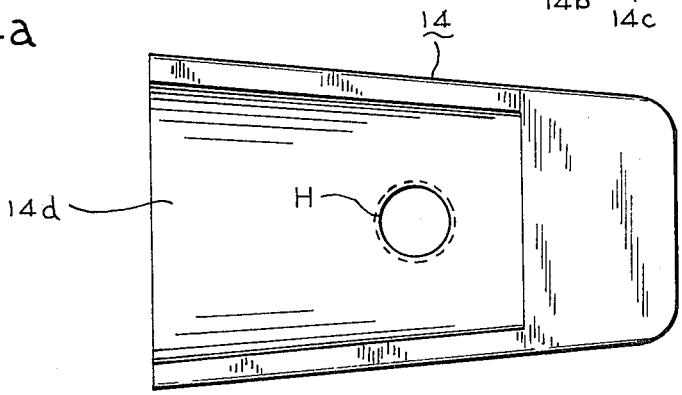

Referring now to FIGS. 4*a*–4*c* there are shown plan views (FIGS. 4*a* and 4*c*) and an end view (FIG. 4*b*) of wedge member 14 of the previous drawing figures. It can be seen by reference to FIG. 4*b* that wedge member 14 is generally trapezoidal in cross section wherein the distance between the longitudinal edges at points along the longer side of wedge member 14 is greater than the corresponding distance between the longitudinal edges along the other side of the wedge member. It can also be seen by reference to FIG. 4*b* that the sides of the wedge member which confront the arcuate inside portions of the C-shaped spring member 12 respectively include arcuately curved surface portions 14*a* which extend from, or adjacent to, the longitudinal edges along the wider side of wedge member 14 to an intermediate point between the longitudinal edges of the confronting surface sides of the wedge member. Thus, the respective arcuately curved portions of the C-shaped spring member 12 and the wedge member 14 form segments of an imaginary circle which generally conforms to the circumference of the conductors C.

It can also be seen by reference to 4*b* that the confronting surface sides of wedge member 14 include tapered portions 14*b* which are tapered toward the longitudinal axis of the wedge member and in the direction away from the intermediate terminal point of the arcuately curved portions 14*a* and toward the longitudinal edges along the shorter side of wedge member 14. Wedge member 14 further includes a substantially flat portion 14*c* which joins and extends a predetermined distance between the tapered and arcuately curved portions 14*a* and 14*b*. It can also be seen by reference to FIGS. 4*a* and 4*c* that wedge member 14 is tapered along the length thereof to correspond to the taper of spring member 12. Wedge member 14 further includes a shallow or undercut portion 14*d* which extends from the wider end of wedge member 14 and across the longitudinal length thereof to a point which is spaced apart from the other end of wedge member 14. The purpose of undercut or shallow portion 14*d* is to permit a degree of flexing of the intermediate portion of C-shaped spring member 12 when the wedge connector is assembled onto the electrical cables. Thus, this degree of free flexing avoids an undesired alteration of the spring characteristics of spring member 12. It has been found that the tapered portions 14*b* of spring member 14 facilitate drawing of wedge member 14 towards spring member 12 during the bolt-assembly of the wedge connector in accordance with the present invention; and, that intermediate flat portion 14*c* functions to constrain the conductors within the assembly while minimizing undesired tangential or residual forces. Further, the tapered portions 14*b* facilitate the initial engagement of wedge member 14 with the cable surface portions to guide and position the cables within the inside arcuate portions of C-shaped spring member 12 prior to the final wedging engagement assembly.

What has been taught, then, is a wedge connector for splicing cables and facilitating mechanical or impact tool assembly as required to meet the needs of a given application. The forms of the inventions illustrated and described herein are but preferred embodiments of these teachings in the forms currently preferred for manufacture. They are illustrated as example, however, rather than by limitation and it is pointed out that various modifications and alterations may be indulged in within the scope of the appended claims.

What is claimed is:

1. A wedge connector for joining a pair of conductors in electrically conductive relationship therewith comprising, in combination:

a longitudinally extending spring member having a substantially C-shaped cross section which tapers from a first cross section at one end thereof to a smaller cross section at the other end thereof; and, a longitudinally extending wedge member which is insertable into said spring member and the length of which is proportional to the length of said spring member, and having a generally trapezoidal cross section which tapers along the length of said wedge member to correspond to the taper of said spring member, and in which the distance between the longitudinal edges at points along one side of said wedge member is greater than the corresponding distance between the longitudinal edges along the other side of said wedge member, and wherein the sides of said wedge member which confront the arcuate inside portions of the C-shaped spring member respectively further include arcuately curved surface portions extending from points adjacent the longitudinal edges along said one side of said wedge member to intermediate points between the longitudinal edges of the confronting surface sides of said wedge member, whereby the respective arcuately curved portions of said C-shaped spring member and said wedge member form segments of an imaginary substantially circular line generally conforming to the circumference of said conductors, and wherein said confronting surface sides of said wedge member include tapered portions which are tapered toward the longitudinal axis of said wedge member in the direction away from said intermediate point and toward the longitudinal edges along said other side of said wedge member and, wherein said wedge member includes a substantially flat portion joining and extending a predetermined distance between said tapered and arcuately curved portions.

2. The wedge connector according to claim 1, wherein said wedge member includes a plurality of longitudinally spaced bore holes therein for receiving therein a fastener extending from the intermediate surface of said C-shaped member, and wherein said wedge member is mounted so that the arcuately curved portions thereof are spaced apart from the intermediate portion of said C-shaped member and adjacent to the arcuately curved terminal end portions of said C-shaped member.

3. The wedge connector according to claim 2, wherein said wedge member includes an undercut portion between said longitudinal edges along said one side of said wedge member so that the surface of said undercut portion is spaced apart from said spring member and the plane defined by said longitudinal edges along said one side of said wedge member.

4. The wedge connector according to claim 1, wherein said wedge member includes a undercut portion between said longitudinal edges along said one side of said wedge member so that the surface of said undercut portion is spaced apart from said spring member and the plane defined by said longitudinal edges along said one side of said wedge member.

* * * * *